US008348402B2

(12) United States Patent
Taga

(10) Patent No.: US 8,348,402 B2
(45) Date of Patent: Jan. 8, 2013

(54) FLUID SUPPLY DEVICE, PRINTING DEVICE, AND METHOD OF CONTROLLING A FLUID SUPPLY DEVICE

(75) Inventor: Susumu Taga, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/539,256

(22) Filed: Jun. 29, 2012

(65) Prior Publication Data

US 2012/0268509 A1 Oct. 25, 2012

Related U.S. Application Data

(63) Continuation of application No. 12/561,211, filed on Sep. 16, 2009, now Pat. No. 8,240,793.

(30) Foreign Application Priority Data

Sep. 17, 2008 (JP) ..... 2008-237321
Aug. 26, 2009 (JP) ..... 2009-195119

(51) Int. Cl.
*B41J 2/175* (2006.01)
*B41J 29/38* (2006.01)
*B41J 2/195* (2006.01)
*B41J 2/17* (2006.01)

(52) U.S. Cl. ..... 347/85; 347/6; 347/7; 347/84; 347/86

(58) Field of Classification Search ..... 347/5–7, 347/19, 84–86, 95
See application file for complete search history.

(56) References Cited

U.S. PATENT DOCUMENTS 6,378,971 B1 4/2002 Tamura et al.
6,582,068 B2 6/2003 Ishizawa et al.
6,758,556 B2 7/2004 Ishizawa et al.
6,783,200 B2 8/2004 Suenaga et al.
6,796,627 B2 9/2004 Kimura et al.
6,834,945 B2 12/2004 Ishizawa et al.
6,874,876 B2 4/2005 Ishizawa et al.
(Continued)

FOREIGN PATENT DOCUMENTS

EP 0 987 878 A1 3/2000
(Continued)

*Primary Examiner* — Charlie Peng
*Assistant Examiner* — Hung Lam
(74) *Attorney, Agent, or Firm* — Kilpatrick Townsend & Stockton LLP

(57) ABSTRACT

A fluid supply device, a printing device, and a control method for a fluid supply device can desirably supply a fluid while maintaining good throughput, and can reduce device size and cost with a simple construction. The inkjet printer has an expansion mechanism that enables an ink refill operation in which a movable member expands an ink chamber by moving a piston that moves in contact with a regulator panel disposed to the main device side and supplies ink from an ink cartridge, a comparison means that determines whether or not the amount of ink left in the ink cartridge is less than a specified value, and a CPU that sets a long time mode in which the ink refill operation time is long when the amount of ink left in the ink cartridge is less than the specified value.

19 Claims, 10 Drawing Sheets

U.S. PATENT DOCUMENTS

| | | | | |
|---|---|---|---|---|
| 7,152,965 | B2 | 12/2006 | Ishizawa et al. | |
| 7,380,909 | B2 | 6/2008 | Ishizawa et al. | |
| 2001/0040610 | A1* | 11/2001 | Kurata et al. | 347/85 |
| 2004/0090501 | A1 | 5/2004 | Yoshida et al. | |
| 2007/0058009 | A1* | 3/2007 | Furukawa et al. | 347/85 |
| 2007/0195140 | A1 | 8/2007 | Ishizawa et al. | |
| 2007/0279462 | A1 | 12/2007 | Ishizawa et al. | |
| 2008/0148859 | A1 | 6/2008 | Aoki et al. | |
| 2008/0309689 | A1 | 12/2008 | Conway et al. | |
| 2009/0322806 | A1 | 12/2009 | Donahue et al. | |

FOREIGN PATENT DOCUMENTS

| | | | |
|---|---|---|---|
| JP | 02-078557 | A | 3/1990 |
| JP | 2001-113716 | A | 4/2001 |
| JP | 2001-239676 | A | 9/2001 |
| JP | 2001-270133 | A | 10/2001 |
| JP | 2002-331680 | A | 11/2002 |
| JP | 2007-160639 | A | 6/2007 |

* cited by examiner

FLUID SUPPLY DEVICE, PRINTING DEVICE, AND METHOD OF CONTROLLING A FLUID SUPPLY DEVICE

This application is a continuation of U.S. patent application Ser. No. 12/561,211, filed Sep. 16, 2009, which claims the benefit of Japanese Patent Application Nos. 2008-237321, filed Sep. 17, 2008 and 2009-195119, the entireties of which are incorporated by reference herein.

BACKGROUND OF THE INVENTION

1. Technical Field

The present invention relates to fluid supply devices that supply fluid from a main tank through a subtank to a head, to printing devices, and to methods of controlling fluid supply devices.

2. Description of Related Art

One example of a fluid supply device is a device that is incorporated in a printer connected to a personal computer, and supplies fluid ink to the print head.

Japanese Unexamined Patent Appl. Pub. JP-A-2001-270133, for example, teaches a fluid supply device having a subtank unit that receives ink from an ink cartridge mounted on a carriage to an ink supply tube into a storage chamber, and supplies ink from the ink storage chamber to the recording head during printing; a pumping means that supplies ink from the ink cartridge to the subtank unit; and a pump control unit that controls ink flow according to a drive signal to the recording head.

Because of the complexity and installation space required by the construction of this pumping means, methods of using the bidirectional movement of the carriage to supply ink for simplification and saving space are also known from the literature. See, for example, Japanese Unexamined Patent Appl. Pub. JP-A-2007-160639.

The ink supply device taught in JP-A-2007-160639 has a carriage that moves bidirectionally, an ink cartridge that stores the ink supplied to an inkjet recording head disposed to the carriage; an ink holding unit that holds the ink consumed for printing by the inkjet recording head; and an ink pump unit that is compressed and feeds ink to the ink holding unit as a result of the carriage moving to a specific position, and recovers and pulls ink from the ink cartridge as a result of the carriage moving to a position away from this specific position.

An ink supply device that works by compressing the ink pump unit using the drive power of the bidirectional movement of the carriage has an ink holding unit, which is a separate tank used as a buffer to store the ink from the ink pump unit. The ink holding unit tends to increase the size and cost of the ink supply device.

A configuration that draws ink from the ink cartridge by using the drive power of the bidirectional movement of the carriage to cause the ink pump unit to expand is used to simplify the construction because this configuration does not require a separate buffer tank. With this configuration the time required to inflate the ink pump unit increases as the amount of ink remaining in the ink cartridge decreases and the negative pressure increases. If the ink supply time is set referenced to a condition in which the remaining ink level is low, however, the ink supply time is longer than necessary when sufficient ink is left in the ink cartridge, and throughput is thus affected.

SUMMARY OF THE INVENTION

A fluid supply device, a printing device, and a control method for a fluid supply device according to the present invention enable supplying fluid while maintaining good throughput and reducing device size and cost by means of a simple configuration.

A fluid supply device according to an aspect of the invention has a main tank in which a fluid is stored in a sealed storage unit of variable capacity; a subtank having a fluid chamber of variable capacity to which fluid is supplied from the main tank; a head that can discharge fluid supplied from the subtank; a movable carriage on which the head and the subtank are mounted; an expansion mechanism that enables a fluid refill operation in which a movable member expands the fluid chamber and supplies fluid from the main tank by means of the movable member that is moved by the movable member that moves in contact with a regulator part disposed on the main device side; a fluid volume detection unit that detects a used fluid volume or remaining fluid volume in the main tank; an evaluation unit that determines based on the fluid volume detected by the fluid volume detection unit that the remaining fluid volume is low when the fluid stored in the main tank is less than a specified value and is sufficient when the fluid stored in the main tank is greater than or equal to the specified level; and a setting unit that when the evaluation unit determines the remaining fluid volume is low sets at least one of a long time mode in which the stop time of the carriage for the fluid refill operation is longer, and a low speed mode in which the speed of carriage movement in the fluid refill operation is slower, than when the remaining fluid volume is sufficient.

Because fluid is stored in a sealed storage unit of changeable capacity in a fluid supply device according to this aspect of the invention, the negative pressure inside the main tank increases when the amount of fluid remaining in the main tank decreases, and the load and time required for the fluid refill operation increase. When the remaining fluid level in the main tank is low, fluid can be reliably filled from the main tank to the subtank by using either or both of a long time mode and a low speed mode. In the long time mode the time that the carriage is stopped for the fluid refill operation is longer, and in the low speed mode the speed of carriage movement during the fluid refill operation is slower, than when the remaining fluid volume is sufficient. Furthermore, the time required for the fluid refill operation can be shortened when the remaining fluid volume in the main tank is sufficient, and the speed of the fluid refill operation can be increased.

In other words, the subtank can be reliably refilled with fluid while greatly increasing throughput efficiency, and device size and cost can be reduced with a simple structure.

In a fluid supply device according to another aspect of the invention, the evaluation unit preferably determines the fluid level is low when the remaining fluid volume is less than the specified level when the fluid volume detection unit detects the remaining fluid volume. The evaluation unit preferably compares the fluid in the main tank with a specified used fluid volume that is the specified level, and determines the fluid level is low if the amount of fluid used is greater than or equal to the specified used fluid volume when the fluid volume detection unit detects the used fluid volume, because the remaining volume can be the detected remaining volume or can be converted from the amount of fluid used.

In a fluid supply device according to another aspect of the invention the specified level is stored as a specified value, or the used volume is stored as a specified usage value, or both values are stored, in a storage unit disposed to the main tank.

The fluid supply device according to this aspect of the invention can smoothly change the mode of the fluid refill operation based on the specified value or the specified usage value stored in the storage unit of the main tank.

In a fluid supply device according to another aspect of the invention the specified level is stored as a specified value, or the used volume is stored as a specified usage value, or both values are stored, in a storage unit disposed in the main device.

The fluid supply device according to this aspect of the invention can smoothly change the mode of the fluid refill operation based on the specified value or the specified usage value stored in the storage unit of the main, device.

In a fluid supply device according to another aspect of the invention the fluid volume detection unit obtains the used fluid volume or the remaining fluid volume of the main tank from the volume of fluid discharged from the head, and the evaluation unit compares the remaining fluid volume in the main tank with the specified value, or compares the used fluid volume with the specified usage value.

The fluid supply device according to this aspect of the invention can readily calculate the remaining fluid volume in the main tank or the used fluid volume from the amount of fluid discharged from the head, and compare the result with a specified value or specified usage value.

In a fluid supply device according to another aspect of the invention the fluid volume detection unit obtains a fluid volume that detects the used fluid volume or the remaining fluid volume in the main tank from the rate of change of the current required to move the carriage; and the evaluation unit determines the remaining fluid volume in the main tank is less than the specified value, or the used fluid volume is greater than or equal to the specified usage value when the rate of change is greater than or equal to a specified rate of change.

When the rate of change of the current needed to move the carriage becomes greater than or equal to a specified rate of change, the fluid supply device according to this aspect of the invention determines that the remaining fluid volume in the main tank is less than the specified value, or the used fluid volume is greater than or equal to the specified usage value, and can smoothly change the mode of the fluid refill operation.

In a fluid supply device according to another aspect of the invention the fluid volume detection unit obtains a fluid volume that detects the used fluid volume or the remaining fluid volume in the main tank from the current required to move the carriage, and the evaluation unit determines the remaining fluid volume in the main tank is less than the specified value, or the used fluid volume is greater than or equal to a specified value, when the current is greater than or equal to a threshold value.

When the current required to move the carriage becomes equal to or greater than a threshold value, the fluid supply device according to this aspect of the invention determines that the remaining fluid volume in the main tank is less than a specified value or that the used fluid volume is greater than or equal to a specified value, and can thus smoothly change the mode of the fluid refill operation.

Another aspect of the invention is a printing device that executes a printing process by discharging ink from a head onto a conveyed medium, and has the fluid supply device according to the present invention as a device that supplies ink to the head.

The printing device according to this aspect of the invention can improve the efficiency of throughput, can also reliably refill the subtank with ink, and can efficiently print on media.

Another aspect of the invention is a control method for a fluid supply device that has a main tank in which a fluid is stored in a sealed storage unit of variable capacity, a subtank having a fluid chamber of variable capacity to which fluid is supplied from the main tank, a head that can discharge fluid supplied from the subtank, a movable carriage on which the head and the subtank are mounted, and an expansion mechanism that enables a fluid refill operation in which a movable member expands the fluid chamber and supplies fluid from the main tank by means of the movable member that is moved by the movable member that moves in contact with a regulator part disposed on the main device side, the control method including: an evaluation step of determining if the remaining fluid volume in the main tank is less than a specified value or is greater than or equal to a specified value; and a setting step that, when the remaining fluid volume in the main tank is less than the specified value, sets at least one of a long time mode in which the stop time of the carriage for the fluid refill operation is longer, and a low speed mode in which the speed of carriage movement in the fluid refill operation is slower, than when the remaining fluid volume is greater than or equal to the specified value.

When the remaining fluid volume in the main tank goes below a specified value and the negative pressure in the main tank rises, the control method for a fluid supply device according to this aspect of the invention sets at least one of a long time mode in which the stop time of the carriage for the fluid refill operation is longer, and a low speed mode in which the speed of carriage movement in the fluid refill operation is slower, than when the remaining fluid volume is greater than or equal to the specified value, and can therefore reliably refill a subtank with fluid from the main tank when the remaining fluid level is low. Moreover, the time of the fluid refill operation can be shortened when the remaining fluid volume in the main tank is greater than or equal to a specified level, and the speed of the fluid refill operation can be increased.

In other words, the subtank can be reliably refilled with fluid while greatly increasing throughput efficiency, and device size and cost can be reduced with a simple structure.

In a control method for a fluid supply device according to another aspect of the invention the evaluation step preferably compares the remaining fluid volume in the main tank obtained from the amount of fluid discharged from the head with the specified value, or compares the used fluid volume with the specified value.

The control method for a fluid supply device according to this aspect of the invention calculates the remaining fluid volume in the main tank or the amount of fluid that was used from the volume of fluid discharged from the head, and can smoothly compare each with a respective specified value.

When the rate of change in the current required to move the carriage becomes equal to or greater than a specified rate of change in a control method for a fluid supply device according to another aspect of the invention, the evaluation step preferably determines the remaining fluid volume in the main tank is less than a specified value or the used fluid volume is greater than or equal to specified value.

When the rate of change in the current required to move the carriage becomes equal to or greater than a specified rate of change, this control method for a fluid supply device determines the remaining fluid volume in the main tank is less than a specified value or the used fluid volume is greater than or equal to specified value, and can smoothly change the mode of the fluid refill operation.

When the current required to move the carriage becomes greater than or equal to a threshold value in a control method for a fluid supply device according to another aspect of the invention, the evaluation step determines that the remaining fluid volume in the main tank is less than a specified value or the used fluid volume is greater than or equal to a specified value.

When the current required to move the carriage becomes greater than or equal to a threshold value, this control method for a fluid supply device determines that the remaining fluid volume in the main tank is less than a specified value or the used fluid volume is greater than or equal to a specified value, and can smoothly change the mode of the fluid refill operation.

Other objects and attainments together with a fuller understanding of the invention will become apparent and appreciated by referring to the following description and claims taken in conjunction with the accompanying drawings.

DESCRIPTION OF PREFERRED EMBODIMENTS

Preferred embodiments of a fluid supply device, a printing device, and a control method for a fluid supply device according to the present invention are described below with reference to the accompanying figures.

Figure 1:
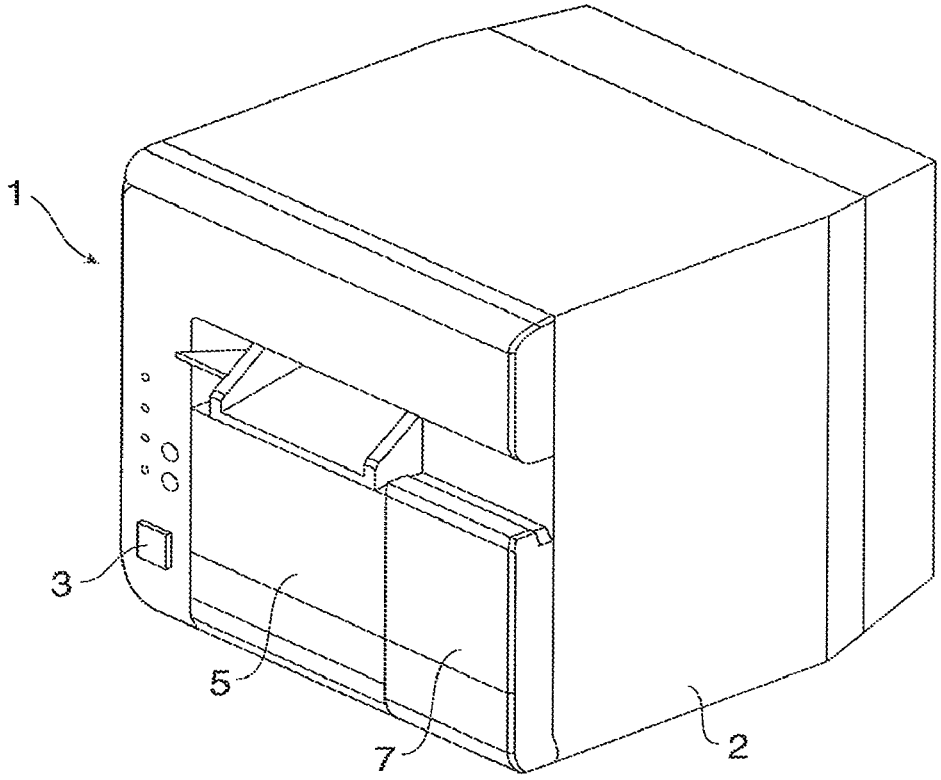
FIG. 1 is an oblique view of an inkjet printer as an example of a printing device according to an embodiment of the invention.
Figure 2:
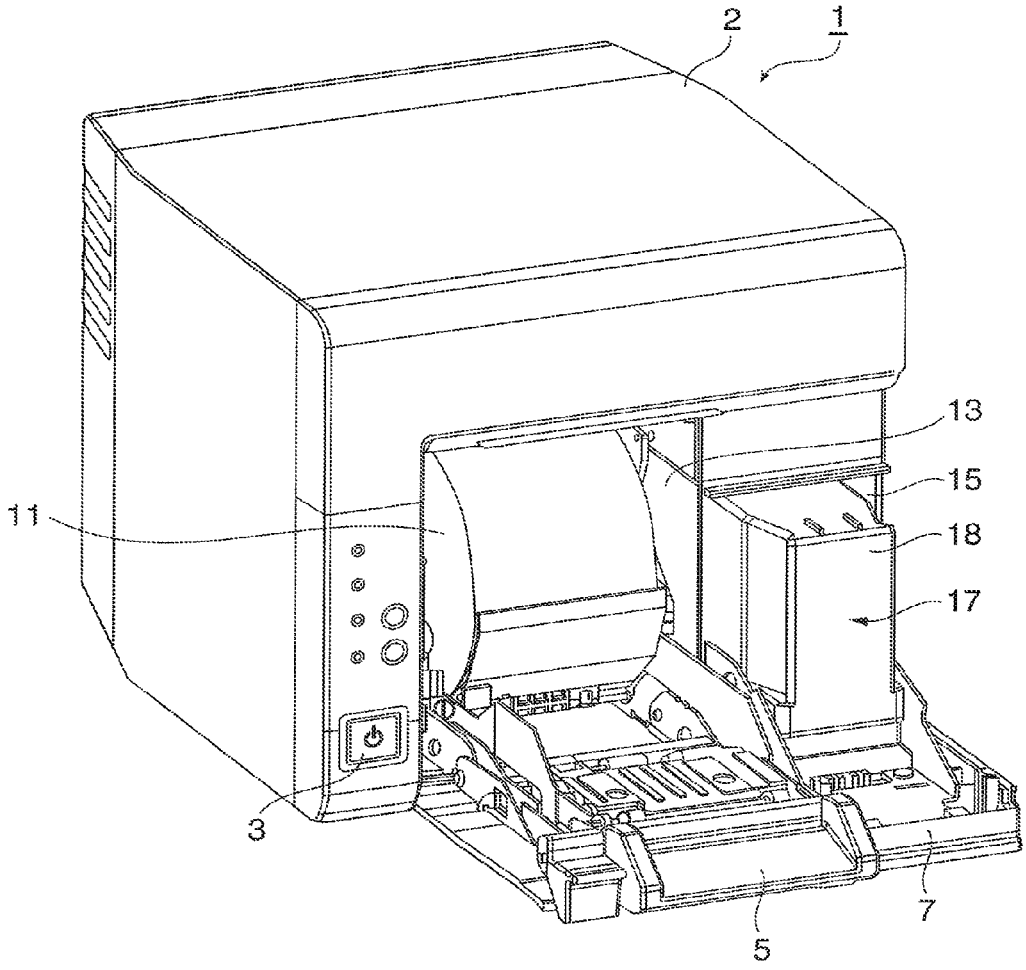
FIG. 2 is an oblique view of the inkjet printer in FIG. 1 with the printer cover open.
Figure 3:
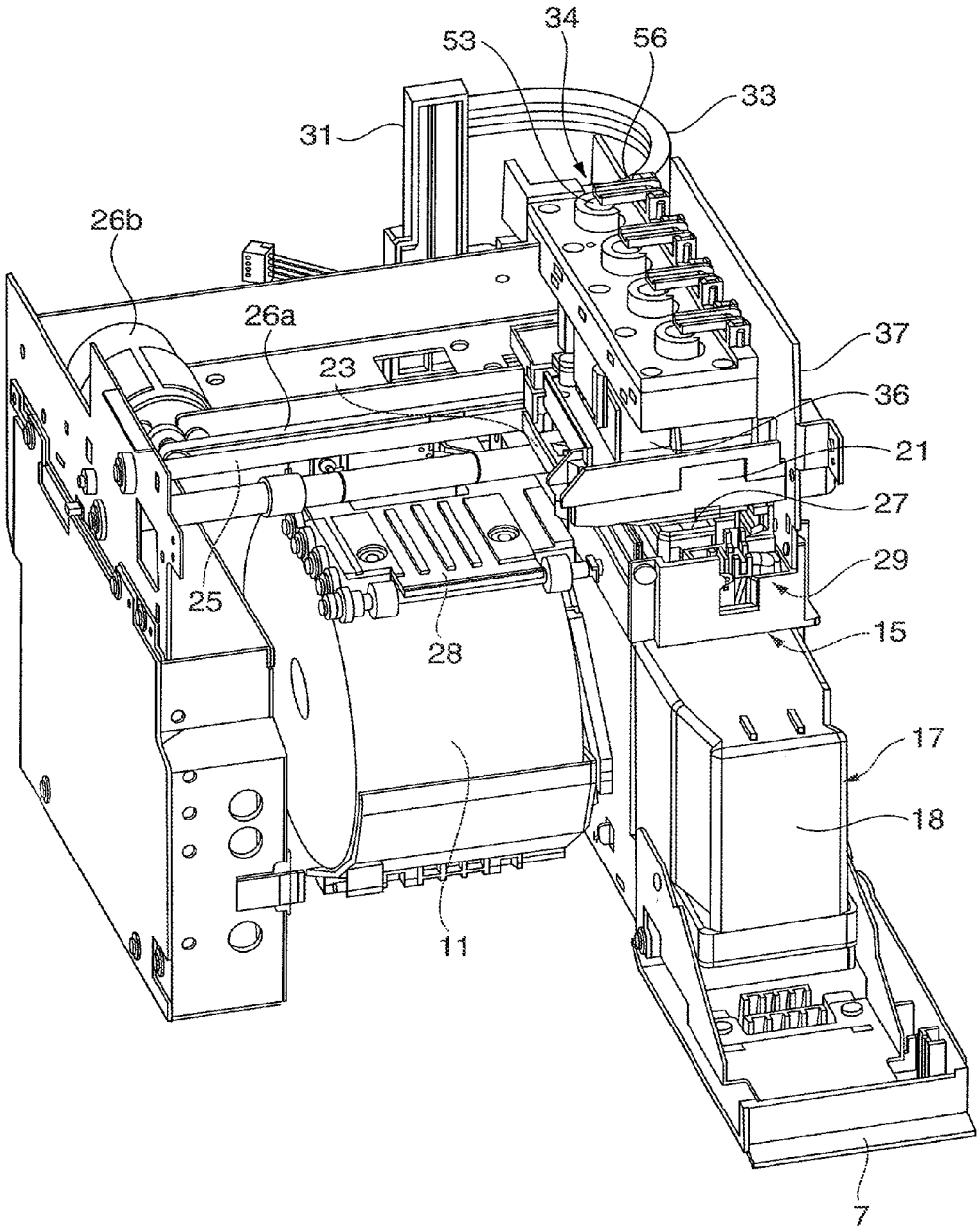
FIG. 3 is an oblique view of the inkjet printer in FIG. 1 with the printer case removed.
Figure 4:
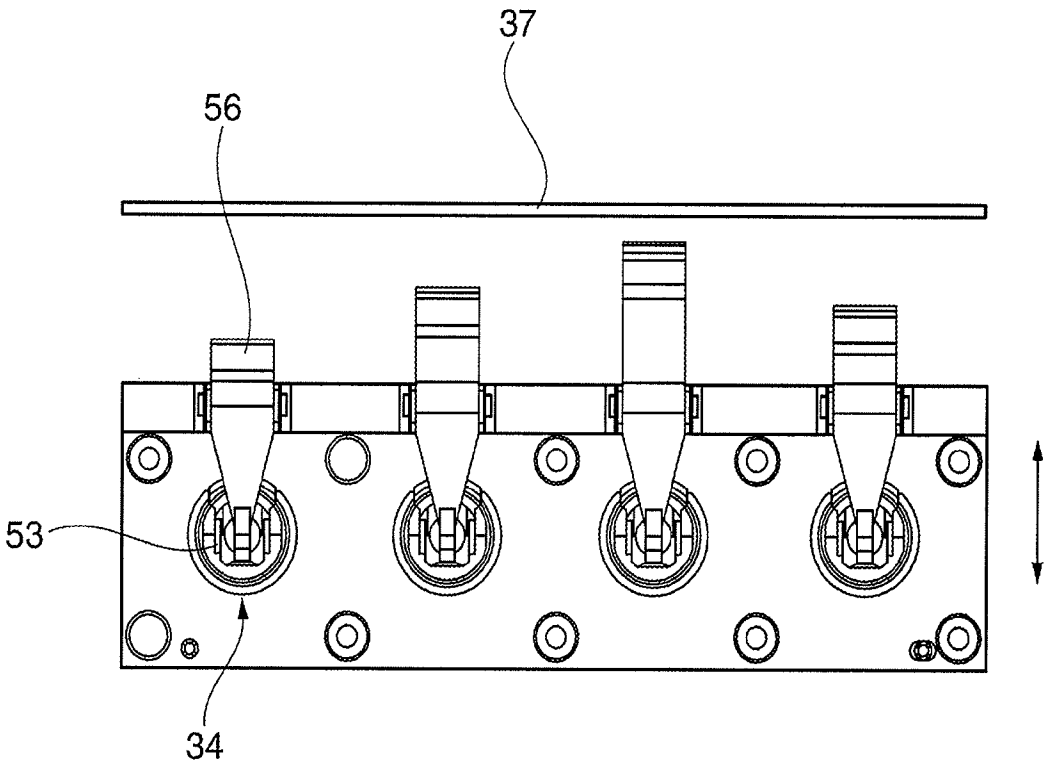
FIG. 4 is a plan view showing the ink pump unit and regulator plate of the inkjet printer in FIG. 1.
Figure 5:
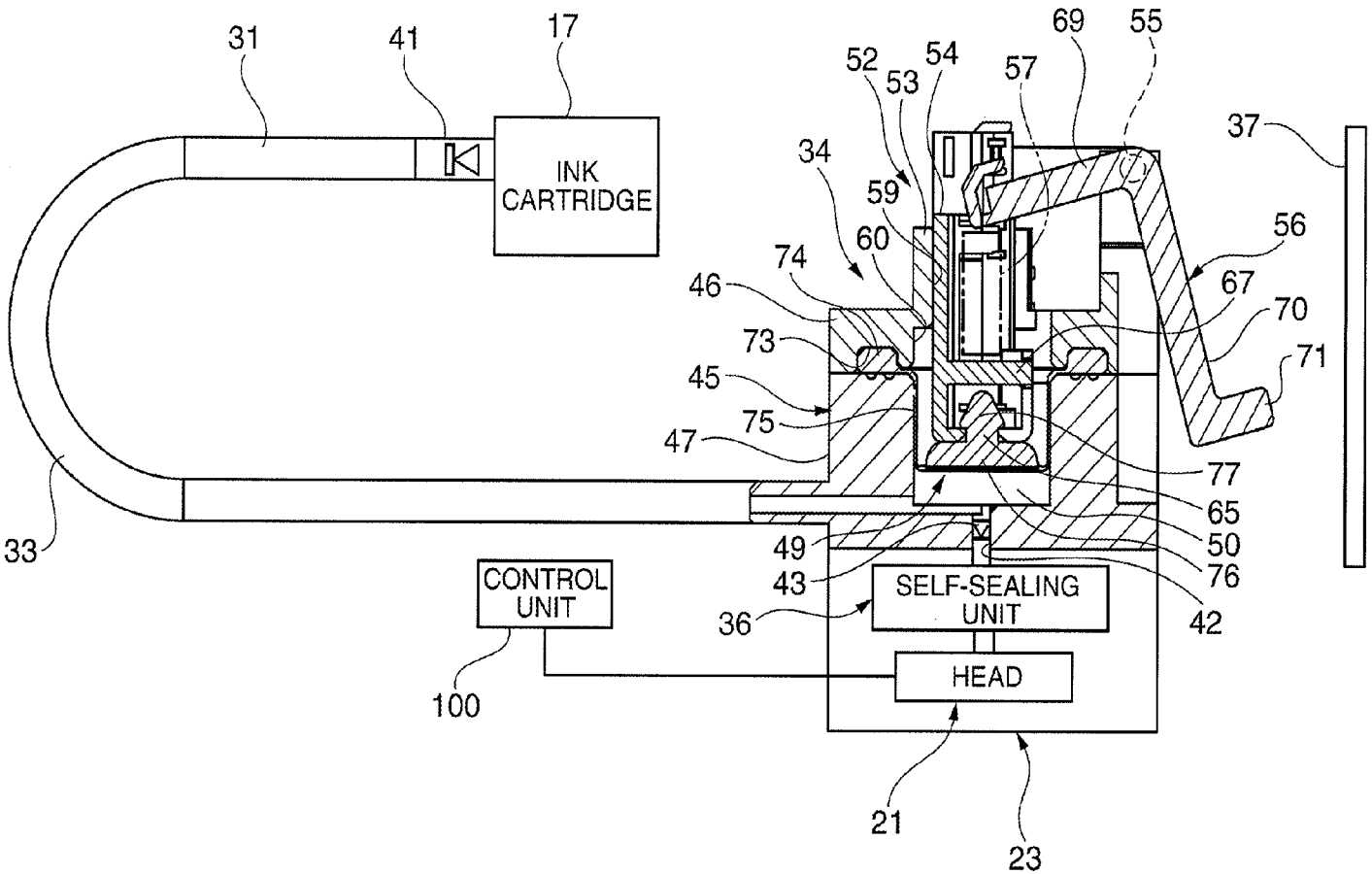
FIG. 5 is a section view showing the main parts of the ink supply mechanism of the inkjet printer in FIG. 1.
Figure 6:
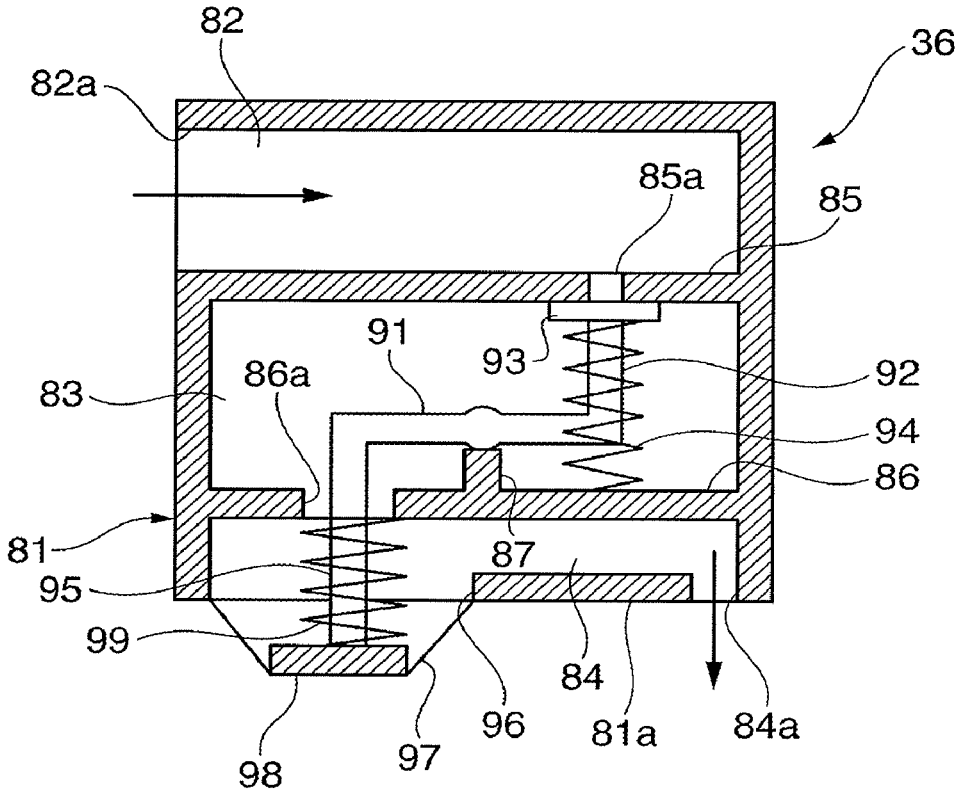
FIG. 6 is a section view showing the structure of the self-sealing unit of the inkjet printer in FIG. 1.
Figure 7:
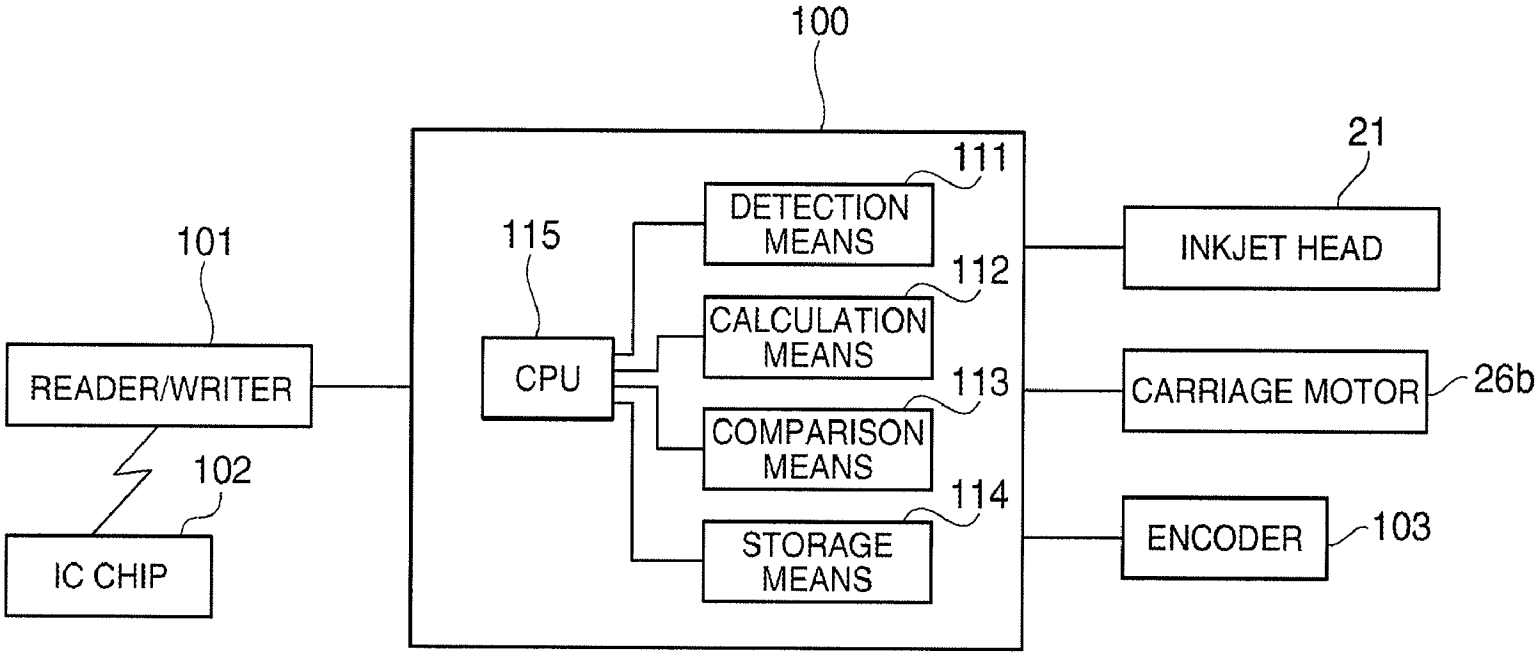
FIG. 7 is a block diagram describing the control system of the inkjet printer in FIG. 1.
Figure 8:
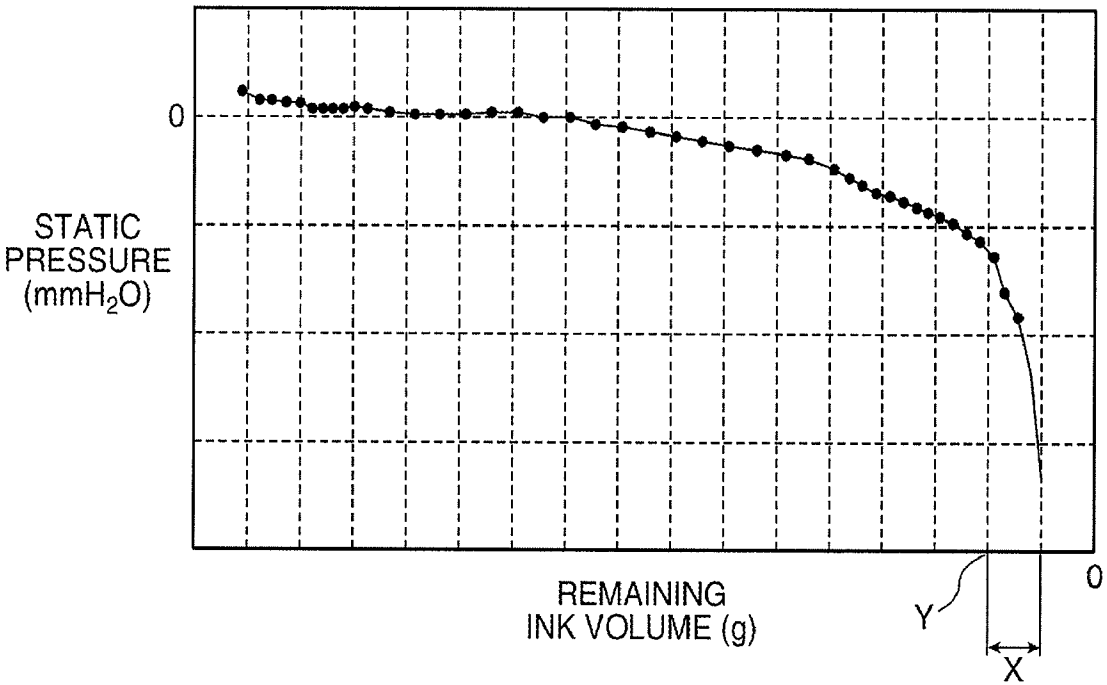
FIG. 8 is a graph showing the relationship between the remaining ink level and the internal pressure of the ink cartridge in the inkjet printer shown in FIG. 1.
Figure 9:
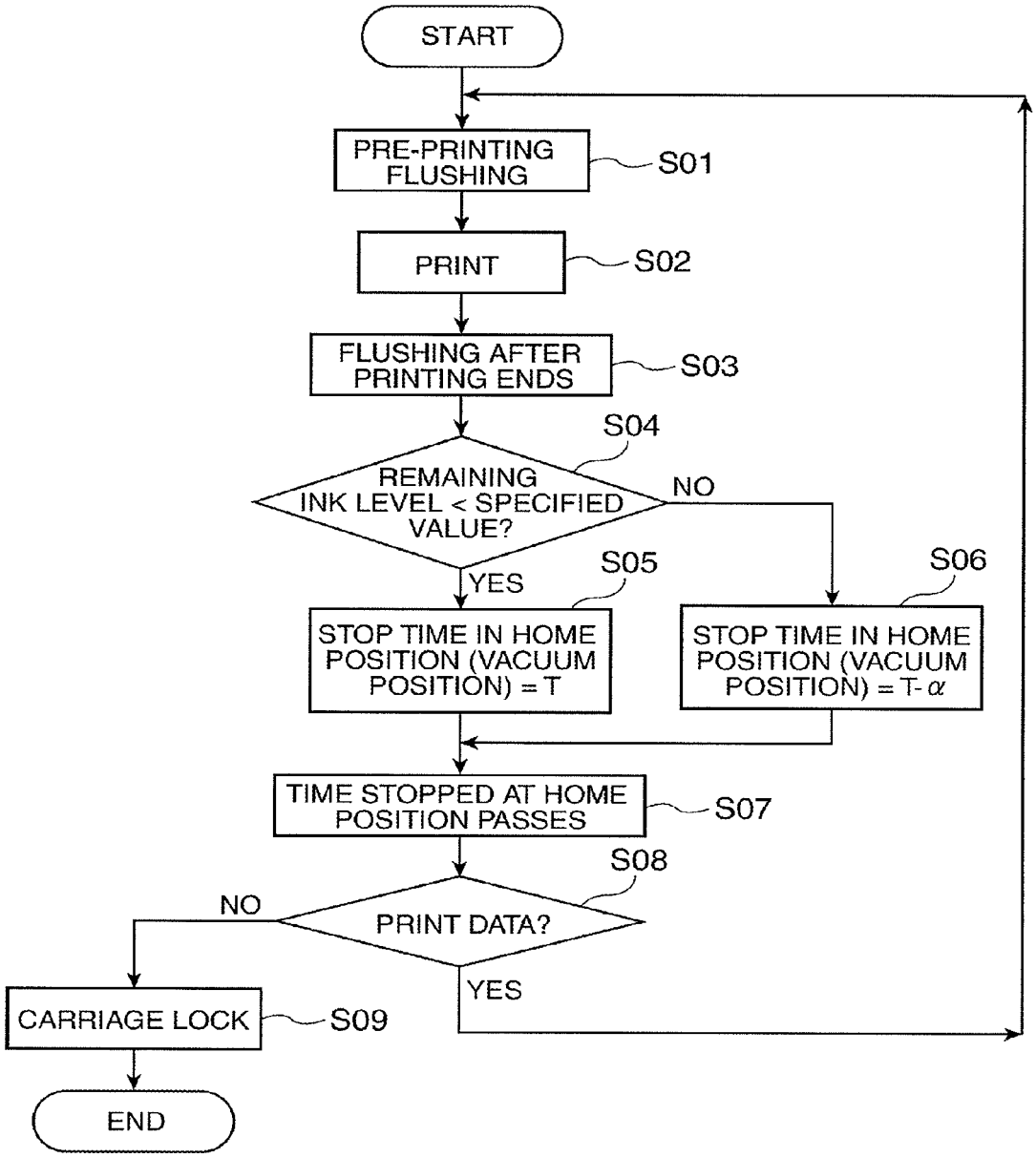
FIG. 9 is a flow chart of ink supply operation control by the control unit of the inkjet printer shown in FIG. 1.

FIG. 1 to FIG. 9 describe an inkjet printer having an ink supply mechanism rendered by a fluid supply device according to a first embodiment of the invention. FIG. 1 is an oblique view of the inkjet printer. FIG. 2 is an oblique view of the inkjet printer with the printer cover open. FIG. 3 is an oblique view of the inkjet printer with the printer case removed. FIG. 4 is a plan view showing the ink pump unit and regulator plate. FIG. 5 is a section view showing the main parts of the ink supply mechanism of the inkjet printer. FIG. 6 is a section view showing the structure of the self-sealing unit. FIG. 7 is a block diagram describing the control system of the inkjet printer. FIG. 8 is a graph showing the relationship between internal pressure and the remaining ink level in the ink cartridge. FIG. 9 is a flow chart describing the ink supply operation of the control unit.

The construction of an inkjet printer described as a printing device according to the invention is described first.

As shown in FIG. 1, the inkjet printer 1 uses a plurality of different colors of ink to print in color on a part of the paper delivered from a roll of paper, and has a roll paper cover 5 and an ink cartridge cover 7 disposed to open and close freely at the front of the printer case 2 that covers the printer assembly. A power switch 3, paper feed switch, and indicators are also disposed to the front of the printer case 2.

Opening the roll paper cover 5 opens the paper compartment 13 in which the roll paper 11 used as the print medium is stored as shown in FIG. 2 so that the roll paper 11 can be replaced.

Opening the ink cartridge cover 7 opens the cartridge loading unit 15, enabling installation and removal of the ink cartridge 17 (main tank) in the cartridge loading unit 15.

Opening the ink cartridge cover 7 also causes the ink cartridge 17 to be pulled a specific distance forward in front of the cartridge loading unit 15.

As shown in FIG. 3, a carriage 23 on which the inkjet head 21 (head) is mounted is disposed above the paper compartment 13 inside the printer case 2. The carriage 23 is supported to move freely widthwise to the paper by means of a guide member 25 that extends widthwise to the roll paper 11, and can be moved bidirectionally widthwise to the roll paper 11 above the platen 28 by means of an endless belt **26*a* disposed widthwise to the roll paper 11 and a carriage motor 26*b* that drives the endless belt 26*a*. The inkjet head 21 prints by discharging ink to the part of the roll paper 11** delivered thereto.

As shown in the figure, the standby position (home position) of the bidirectionally moving carriage 23 is above the cartridge loading unit 15. A cap 27 that covers the ink nozzles of the inkjet head 21 exposed below the carriage 23, and an ink vacuum mechanism 29 for vacuuming and disposing of ink inside the ink nozzles of the inkjet head 21 through the cap 27, are disposed below this standby position.

At a specific time or when initiated by a user operation, the inkjet printer 1 executes a cleaning process that sets the cap 27 tight to the ink nozzle surface of the inkjet head 21 and vacuums the inside by means of the ink vacuum mechanism 29 to draw any air bubbles or high viscosity ink out from the ink nozzles.

The inkjet printer 1 also executes a flushing process regularly or before or after the printing process to discharge a specific volume of ink droplets from the ink nozzles of the inkjet head 21 into the cap 27 in order to form a desirable ink meniscus in the ink nozzles of the inkjet head 21.

The inkjet printer 1 also executes a capping operation to protect and prevent clogging the ink nozzles by setting the cap 27 tight to the ink nozzle surface of the inkjet head 21 positioned at the home position after printing stops.

The ink cartridge 17 stores a plurality of color ink packs (not shown) inside the cartridge case 18. Each of the ink packs (storage units) inside the ink cartridge 17 is made of a flexible material and is sealed with ink stored inside. When the ink cartridge 17 is loaded into the cartridge loading unit 15, an ink supply needle (not shown) disposed on the cartridge loading unit 15 side is inserted to and connects with the ink supply opening of the ink pack. The ink path 31 fixed inside the printer case 2 is connected to the ink supply needle of the cartridge loading unit 15, and one end of a flexible ink supply tube 33 having a channel for each color is connected to the ink path 31.

The other end of the ink supply tube 33 is connected to an ink pump unit 34 disposed to the carriage 23 for each color. Each ink pump unit 34 is disposed above the inkjet head 21, and connected to the self-sealing unit 36 connected to the inkjet head 21.

In addition to the inkjet head 21, the ink pump unit 34 and the self-sealing unit 36 are disposed in unison with the carriage 23.

As a result, ink from each ink pack inside the ink cartridge 17 is supplied to the ink nozzles of the inkjet head 21 from the ink supply needle of the cartridge loading unit 15 through the ink path 31, the ink supply tube 33, the ink pump unit 34 for each color, and the self-sealing unit 36 for each color.

The ink pump unit 34 pulls ink from the ink cartridge 17 by moving the carriage 23 relative to the frame of the printer 1. A regulator panel 37, that causes the ink pump unit 34 to operate by moving the carriage 23, is disposed to the front in the direction of carriage 23 movement to the standby position.

The ink supply mechanism (fluid supply mechanism) in this inkjet printer 1 is rendered by the ink cartridge 17, the subtank 45, the inkjet head 21, the carriage 23, and the ink pump unit 34.

The ink pump unit 34 of the ink supply mechanism is described below using by way of example the structure related to one color.

As shown in FIG. 5, a backflow prevention valve 41 is disposed to one end of the ink path 31 on the ink cartridge 17 side, and the backflow prevention valve 41 prevents ink from flowing between the ink cartridge 17 and the ink pump unit 34 from the ink cartridge 17 side to the ink pump unit 34 side.

The ink pump unit 34 includes a subtank 45 for drawing ink from the ink cartridge 17 through the ink supply tube 33. This subtank 45 has a top part 46 and a bottom part 47, and an ink chamber 50 (fluid chamber) is formed between the top part 46 and bottom part 47 with the top of the ink chamber 50 covered by a flexible membrane 49 that is a flexible diaphragm. The flexible membrane 49 is made of butyl rubber, for example, with low moisture permeability and gas permeability.

The ink chamber 50 communicates with the ink supply tube 33 and with the path 42 on the self-sealing unit 36 side so that ink can be supplied from the ink cartridge 17, and ink can be supplied to the self-sealing unit 36 side. A backflow prevention valve 43 is disposed to the end of the path 42 on the self-sealing unit 36 side, and the backflow prevention valve 43 enables ink to flow between the ink chamber 50 and self-sealing unit 36 from the ink chamber 50 side to the self-sealing unit 36 side.

The flexible membrane 49 is made from an easily deformable flexible material, and the volume of the ink chamber 50 can change, i.e., expand and contract, as the flexible membrane 49 deforms. An expansion mechanism 52 that causes the flexible membrane 49 to displace to expand the ink chamber 50 is disposed to the ink pump unit 34.

The expansion mechanism 52 includes a tubular cylinder 53 that rises vertically, a piston 54 (moving member) that is inserted so that it can slide vertically inside the cylinder 53, a rocker arm 56 (engaging member) that is supported to rock on a rocker pin 55 above the cylinder 53 in the top part 46, and a coil tension spring 57 (elastic unit) that is interposed between the rocker arm 56 and piston 54.

The cylinder 53 is made from a plastic material, such as polypropylene with low moisture permeability and gas permeability. The cylinder 53 has a necked configuration with a small diameter inside surface 59 formed at the top with an inside diameter that is slightly greater than the outside diameter of the piston 54 to slidably guide the outside surface of the piston 54, and a large diameter inside surface 60 formed at the bottom with a space between it and the outside surface of the piston 54.

The piston 54 is made from a plastic material, such as polypropylene with low moisture permeability and gas permeability. The piston 54 is substantially cylindrical with a bottom, and has a slot from the top end to the middle on the rocker arm 56 side for positioning the rocker arm 56.

A catch 67 that holds the bottom end of the coil tension spring 57 is formed at a position above the bottom of the piston 54.

The rocker arm 56 has an arm part 69 that extends inside the cylinder 53 from the rocker pin 55, a vertical leg 70 that extends down from the rocker pin 55, and an input part 71 that extends in the opposite direction from the opposite end of the vertical leg 70. The distal end of the arm part 69 is hook shaped, and holds the top end of the coil tension spring 57.

The flexible membrane 49 is an integral molding having an annular thick-wall base part 74 that is disposed between the top part 46 and bottom part 47 and fit into an annular groove 73 in the top part 46. A thin-wall membrane part 75 extends with a cylindrical shape from the inside diameter part of the base part 74, and a thick-walled, substantially disc-shaped fixed part 76 that occludes the opposite side of the membrane part 75 as the base part 74.

A nipple 77 that tapers substantially to a point at the distal end is formed in unison to the middle of the fixed part 76. The nipple 77 is press-fit into and held by a slit 65 formed in the piston 54. When thus disposed, the fixed part 76 is held in unison with the bottom of the piston 54, and the fixed part 76 and membrane part 75 of the flexible membrane 49 are displaced as the piston 54 moves.

As shown in FIG. 6, the self-sealing unit 36 has a supply path 82, a middle path 83, and a discharge path 84 formed in a unit housing 81. The downstream end part of the path 42 is connected to the supply opening 82*a* rendered to the supply path 82, and the inkjet head 21 is connected to the discharge opening 84*a* rendered to the discharge path 84.

A flow opening 85*a* is formed in the divider wall 85 separating the supply path 82 and middle path 83, and ink in the supply path 82 flows through the flow opening 85*a* into the middle path 83. A communication hole 86*a* is formed in the divider wall 86 separating the middle path 83 and discharge path 84, and ink in the middle path 83 flows through this communication hole 86*a* into the discharge path 84.

A support unit 87 is formed on the divider wall 86 inside the middle path 83, and a rocker arm 91 is pivotably supported on this support unit 87. An operating rod 92 that bends toward the divider wall 85 side is formed in unison to one end of the rocker arm 91. An occlusion plate 93 that contacts the divider wall 85 and closes the flow opening 85*a* is rendered on the distal end of this operating rod 92. A compression spring 94 is disposed between the occlusion plate 93 and divider wall 86, and the occlusion plate 93 is urged toward the divider wall 85 side by the urging force of this compression spring 94. A pusher rod 95 that is inserted through the communication hole 86*a* in the divider wall 86 is foamed bending toward the divider wall 86 side at the other end of the rocker arm 91.

An opening 96 is foamed in the side wall 81*a* of the unit housing 81 on the discharge path 84 side. A film 97 that is liquid-tight and flexible is attached with a liquid-tight connection to the lip part of the opening 96. A pressure plate 98 is fixed to the middle part of the film 97 on the discharge path 84 side. The distal end of the pusher rod 95 part of the rocker arm 91 contacts the pressure plate 98.

A compression spring 99 is attached between the pressure plate 98 and the divider wall 86, and the pressure plate 98 is pushed to the outside by the urging force of this compression spring 99. The occlusion plate 93 in this self-sealing unit 36 is thus pressed to the divider wall 85 by the compression spring 94 and the pressure working on the occlusion plate 93, and thus closes the flow opening 85*a*.

When the capacity of the part covered by the film 97 in this self-sealing unit 36 decreases and the pusher rod 95 part of the rocker arm 91 is pushed by the pressure plate 98, the rocker arm 91 rocks at the point where it is supported on the support unit 87, and the occlusion plate 93 separates from the divider wall 85. Ink thus flows from the supply path 82 through the flow opening 85*a* into the middle path 83 and discharge path 84, and is supplied to the inkjet head 21.

By disposing this self-sealing unit 36 on the upstream side of the inkjet head 21, variation in the ink pressure on the supply side caused by acceleration or deceleration of the carriage 23, for example, is prevented by the self-sealing unit 36 from being transmitted to the inkjet head 21.

As a result, problems caused by transmission of such pressure variation, including unintended discharge of ink from the inkjet head 21, ink smears, and missing dots caused by defective discharge, for example, are prevented.

When the carriage 23 is in the standby position in the inkjet printer 1 configured as described above, the input part 71 of the rocker arm 56 contacts the regulator panel 37 of the carriage 23, the vertical leg 70 is vertical, and the arm part 69 and input part 71 are horizontal. The piston 54 is pulled up by the urging force of the coil tension spring 57 at this time.

When the carriage 23 leaves the standby position and is moved to the printing area of the inkjet head 21, and ink is then discharged from the inkjet head 21 in the printing area to print, ink is supplied from the self-sealing unit 36 to the inkjet head 21, the inside of the self-sealing unit 36 goes to negative pressure, and ink is supplied from the ink chamber 50 through the path 42 to the self-sealing unit 36.

When the amount of ink in the ink chamber 50 drops, the decrease in ink produces a negative pressure, and the piston 54 and fixed part 76 descend in unison while deforming the membrane part 75 of the flexible membrane 49. As a result, the rocker arm 56 connected through the coil tension spring 57 to the piston 54 rocks and causes the distal end of the arm part 69 to descend, thus causing the amount that the rocker arm 56 protrudes to the input part 71 side to increase.

When the carriage 23 returns to the standby position, the rocker arm 56 that moves with the carriage 23 contacts the regulator panel 37 outside the carriage 23 at the input part 71, the rocker atm 56 therefore rocks as a result of carriage 23 movement, and the input part 71 returns to vertical and the arm part 69 and input part 71 return to horizontal. As a result, the distal end part of the arm part 69 rises, and the piston 54 connected thereto through the coil tension spring 57 slides inside the cylinder 53 and is pulled up.

Movement of the piston 54 through the coil tension spring 57 causes the fixed part 76 of the flexible membrane 49 of the ink pump unit 34 to rise in unison with the piston 54, expanding the ink chamber 50 of the subtank 45 and increasing the capacity. When the capacity of the ink chamber 50 increases, ink is drawn into the ink chamber 50 through the ink path 31 and ink supply tube 33 from the ink cartridge 17 while the backflow prevention valve 41 opens and the backflow prevention valve 43 closes.

The control unit 100 of the inkjet printer 1 configured as described above executes the above ink supply operation at a specific timing during the printing operation. Note that this ink supply operation is executed as long as there is at least enough ink left in the ink chamber 50 to enable supplying ink to the inkjet head 21 even if printing consumes the maximum amount of ink.

As shown in FIG. 7, the control unit 100 of the inkjet printer 1 controls driving the inkjet head 21 and carriage motor 26*b* by sending control signals to the inkjet head 21 and carriage motor 26*b* to execute the roll paper 11 printing process, for example. An encoder 103 that sends carriage 23 position information is also connected to the control unit 100, and the control unit 100 detects the position of the carriage 23 based on the signal from the encoder 103.

The control unit 100 has a detection means 111 that detects the carriage motor 26*b* current, a calculation means (fluid volume detection unit) 112, a comparison means (evaluation unit) 113, a storage means 114 and a CPU (settings unit) 115. The detection means 111, calculation means 112, and comparison means 113 are controlled by means of the CPU 115.

A reader/writer 101 is also connected to the control unit 100. The reader/writer 101 reads and writes ink information to an IC chip 102 (storage means) disposed in the ink cartridge 17. The ink information written to the IC chip 102 includes, for example, ink consumption (ink usage), the remaining ink level, the waste ink amount, the date of first use, and device information denoting the device using the ink cartridge 17, for example.

The control unit 100 reads the ink information stored in the IC chip 102 of the ink cartridge 17 loaded in the cartridge loading unit 15 by means of the reader/writer 101. If the loaded ink cartridge 17 is new, the date of first use and the device information is written to the IC chip 102.

When a printing process or cleaning process is executed, the calculation means 112 determines the dot count denoting the number of ink droplets discharged from the inkjet head 21 in the printing process, flushing process, or cleaning process, updates the total ink consumption value by adding the calculated dot count to the ink consumption value already stored as a dot count in the IC chip 102, and writes the updated dot count to the IC chip 102.

As shown in FIG. 8, the pressure inside the ink cartridge 17 decreases gradually as the remaining ink level drops, and then drops abruptly in the near-end range X where the ink is nearly depleted.

Therefore, when the remaining ink level of the ink cartridge 17 is in the near-end range X and the carriage 23 is moved to the standby position to refill the ink chamber 50 with ink from the ink cartridge 17, the length of time that the rocker arm 56 of the subtank 45 of the ink pump unit 34 is in contact with the regulator panel 37 to draw ink into the ink chamber 50 increases, and the load increases.

If the ink refill time is set to when the ink level is in this near-end range X, the ink refill time is longer than necessary when the remaining ink level in the ink cartridge 17 is sufficient, and throughput is thus affected.

The control unit 100 in this embodiment of the invention therefore controls the ink refill operation according to the relationship between the negative pressure and the remaining ink level in the ink cartridge 17.

Note that the remaining ink level Y that marks the boundary to the near-end range X in the relationship between the remaining ink level and negative pressure is stored as a predetermined value in the IC chip 102 of the ink cartridge 17.

The ink refill operation of the control unit 100 is described next with reference to the flow chart in FIG. 9.

When print data is sent to the inkjet printer 1, pre-printing flushing occurs, and a meniscus is formed in the ink nozzles of the inkjet head 21 (step S01).

The carriage 23 then moves to the printing area, and the inkjet head 21 prints on the roll paper 11 in accordance with the print data (step S02).

When the printing process ends, flushing occurs again (step S03) and the ink refill operation that refills the ink pump unit 34 with the amount of ink consumed by the printing process and flushing is performed.

In the ink refill operation the calculation means 112 first determines the remaining ink level of the ink cartridge 17 based on the ink information in the IC chip 102 and how much ink was consumed by the printing process and flushing. The comparison means 113 then compares this remaining ink level with the specified value Yg stored in the IC chip 102, and determines if the remaining ink level is less than the specified value (evaluation step, step S04).

If it is determined that the remaining ink level is less than the specified value (step S04 returns Yes), a "low ink level" is returned and the CPU 115 sets the ink refill operation to a long time mode (setting step, step S05).

The ink refill operation time in the long time mode is the time required to draw the ink into the ink chamber 50 of the ink pump unit 34 in the highest negative pressure state in the near-end range X of the relationship between the negative pressure and remaining ink level in the ink cartridge 17, and is set as time T.

If the remaining ink level is greater than or equal to the specified level (step S04 returns No), a "sufficient ink level" is returned and the CPU 115 sets the ink refill operation time to a short time mode (setting step, step S06).

The ink refill operation time in the short time mode is the time required to draw the ink into the ink chamber 50 of the ink pump unit 34 in the sufficient remaining ink level state outside the near-end range X. The relationship between the negative pressure and remaining ink level of the ink cartridge 17, and is set as time $T-\alpha$, which is a refill time a shorter than the ink refill operation time T in the long time mode.

Once the long time mode or short time mode is set, the ink refill operation of the appropriately set ink refill operation time starts. More specifically, the carriage 23 returns to the standby position and stops for ink refill operation time T in the long time mode and for ink refill operation time $T-\alpha$ in the short time mode (step S07).

As a result, the rocker arm 56 that moves with the carriage 23 contacts the regulator panel 37 outside the carriage 23 at the input part 71 and rocks, causing the distal end part of the arm part 69 to rise and the piston 54 connected thereto through the coil tension spring 57 to slide inside the cylinder 53 and be pulled up.

Movement of the piston 54 by means of the coil tension spring 57 causes the fixed part 76 of the flexible membrane 49 of the ink pump unit 34 to rise in unison with the piston 54, expanding the ink chamber 50 of the subtank 45 and increasing the capacity. When the capacity of the ink chamber 50 increases, ink is drawn into the ink chamber 50 through the ink path 31 and ink supply tube 33 from the ink cartridge 17 while the backflow prevention valve 41 opens and the backflow prevention valve 43 closes.

If additional print data is then sent (step S08 returns Yes), control goes to step S01 and the printing and ink refill operations repeat.

If additional print data is not sent after the ink refill operation (step S08 returns No), a carriage lock state in which the ink nozzle surface of the inkjet head 21 set to the standby position is tightly capped and protected by the cap 27 is entered (step S09), and the process then ends.

For a structure that refills a subtank with ink from an ink cat fridge 17 as a result of an expansion mechanism 52 expanding the ink chamber 50 by means of the force of carriage 23 movement, the ink refill operation time is set to a long time mode when the remaining ink level in the ink cartridge 17 is less than a predetermined level and the negative pressure in the ink cartridge 17 is high. As a result, ink can be reliably refilled from the ink cartridge 17 to the subtank 45 when the remaining ink level is low. In addition, a short ink refill operation time can be set when the remaining ink level in the ink cartridge 17 is sufficient, that is, is greater than said predetermined level.

In other words, throughput can be greatly increased and printing can be done efficiently while the subtank 45 can be reliably refilled with ink. The size and cost of the device can also be reduced by means of a simple structure.

Furthermore, because the predetermined value that is used to determine whether to change the operating mode is stored in the IC chip 102 of the ink cartridge 17, the predetermined value can be read from the IC chip 102 of the ink cartridge 17, and the mode used for the ink refill operation can be changed smoothly based on the predetermined value.

The remaining ink level in the ink cartridge 17 can also be easily calculated from the amount of ink discharged from the inkjet head 21, and can be easily compared with the predetermined value.

The embodiment of the invention described above changes the ink refill operation time of the ink refill operation according to how much ink remains in the ink cartridge 17, but the speed of the ink refill operation that is determined by the speed of ink cartridge 12 movement may instead be changed according to how much ink remains in the ink cartridge 17.

Figure 10:
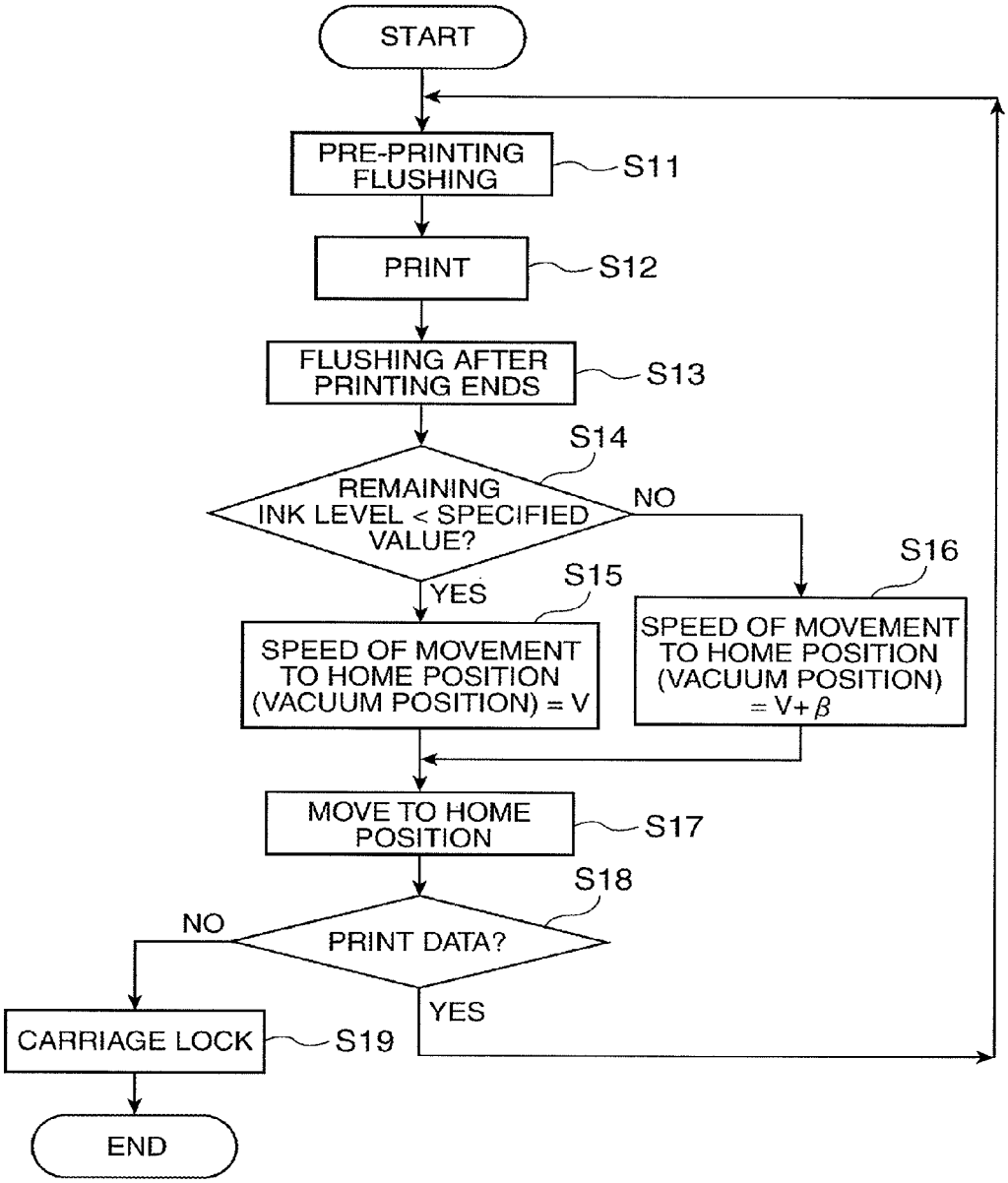
FIG. 10 is a flow chart describing another example of ink supply operation control by the control unit of the inkjet printer shown in FIG. 1.

FIG. 10 is a flow chart of an ink refill operation control method that changes the speed of carriage 23 movement in the ink refill operation. This method differs from the control method described above in that the steps of changing the ink refill operation time (steps S05 and S06) are changed.

An ink refill operation control method that changes the ink refill operation speed is described next.

The ink refill operation of the control unit 100 is described next with reference to the flow chart in FIG. 9.

When print data is sent to the inkjet printer 1, pre-printing flushing occurs, and a meniscus is formed in the ink nozzles of the inkjet head 21 (step S11).

The carriage 23 then moves to the printing area, and the inkjet head 21 prints on the roll paper 11 in accordance with the print data (step S12).

When the printing process ends, flushing occurs again (step S13) and the ink refill operation that refills the ink pump unit 34 with the amount of ink consumed by the printing process and flushing is performed.

In the ink refill operation the calculation means 112 first determines the remaining ink level of the ink cartridge 17 based on the ink information in the IC chip 102 and how much ink was consumed by the printing process and flushing. The comparison means 113 then compares this remaining ink level with the specified value stored in the IC chip 102, and determines whether or not the remaining ink level is less than the specified value (evaluation step, step S14).

If the remaining ink level evaluation step (step S14) detects a "low ink level" (step S04 returns Yes), the CPU 115 sets the ink refill operation speed to a low speed mode (setting step, step S15).

The speed of the ink refill operation in the low speed mode is the speed appropriate to drawing ink into the ink chamber 50 of the ink pump unit 34 in the highest negative pressure state in the near-end range X of the relationship between the negative pressure and remaining ink level in the ink cartridge 17, and is set as speed V.

If the remaining ink level is greater than or equal to the predetermined level (step S14 returns No), a "sufficient ink level" is returned and the CPU 115 sets the ink refill operation speed to a high speed mode (setting step, step S16).

The speed of the ink refill operation in the high speed mode is the speed required to draw the ink into the ink chamber 50 of the ink pump unit 34 in the sufficient remaining ink level state outside the near-end range X in the relationship between the negative pressure and remaining ink level of the ink cartridge 17, and is set as speed $V+\beta$, which is a compensation speed 13 faster than the ink refill operation speed V in the low speed mode.

Once the low speed mode or high speed mode is set, the ink refill operation starts at the appropriately set ink refill operation speed (step S17).

More specifically, when the carriage 23 returns to the standby position, the carriage 23 moves at ink refill operation speed V in the low speed mode and at ink refill operation speed V+β in the high speed mode.

As a result, the rocker arm 56 that moves with the carriage 23 contacts the regulator panel 37 outside the carriage 23 at the input part 71 and rocks, causing the distal end part of the arm part 69 to rise and the piston 54 connected thereto through the coil tension spring 57 to slide inside the cylinder 53 and be pulled up.

Movement of the piston 54 by means of the coil tension spring 57 causes the fixed part 76 of the flexible membrane 49 of the ink pump unit 34 to rise in unison with the piston 54, expanding the ink chamber 50 of the subtank 45 and increasing the capacity. When the capacity of the ink chamber 50 increases, ink is drawn into the ink chamber 50 through the ink path 31 and ink supply tube 33 from the ink cartridge 17 while the backflow prevention valve 41 opens and the backflow prevention valve 43 closes.

If additional print data is then sent (step S18 returns Yes), control goes to step S11 and the printing and ink refill operations repeat.

If additional print data is not sent after the ink refill operation (step S18 returns No), a carriage lock state in which the ink nozzle surface of the inkjet head 21 set to the standby position is tightly capped and protected by the cap 27 is entered (step S19), and the process then ends.

Because the ink refill operation speed is set to a low speed mode when the remaining ink level in the ink cartridge 17 is less than a predetermined level and the negative pressure inside the ink cartridge 17 is high, the subtank 45 can also be reliably refilled with ink from a nearly empty ink cartridge 17 when the ink refill operation speed is changed in the ink refill operation. The ink refill operation speed can also be increased when the remaining ink level in the ink cartridge 17 is greater than or equal to the predetermined level, and throughput can thus be improved.

It should be noted that the foregoing embodiments describe changing the ink refill operation time or the ink refill operation speed according to how much ink remains in the ink cartridge 17, but both the ink refill operation time and the ink refill operation speed may be changed.

For example, when the remaining ink level is the low level, that is, is less than the predetermined value, in the evaluation step comparing the remaining ink level with the predetermined value, the stop time of the carriage for the ink refill operation may be set longer than the stop time when the remaining ink level is the sufficient level, that is, is greater than the predetermined value, and the speed of carriage movement in the ink refill operation may be set to a slower speed than when the remaining ink level is the sufficient level.

By thus increasing the ink refill operation time or slowing the ink refill operation speed when the remaining ink level in the ink cartridge 17 is less than a predetermined value and the negative pressure in the ink cartridge 17 is high, the subtank 45 can be reliably replenished with fluid from an ink cartridge 17 in which the remaining ink level is low.

The foregoing embodiments are described based on an example that detects the remaining ink level in an ink cartridge 17, but the remaining ink level of the ink cartridge 17 can be determined by detecting ink usage. When the stop time of the carriage is changed in this configuration, "the comparison means 113 then compares this remaining ink level with the specified value Yg stored in the IC chip 102, and determines if the remaining ink level is less than the specified value" in the evaluation step of step S04 in FIG. 9 is changed to "the comparison means 113 compares this ink consumption with a predetermined usage value for fluid consumption corresponding to the remaining amount Y stored in IC chip 102, and determines the remaining ink level is low if the amount consumed, which is the amount used, is greater than or equal to the predetermined usage value," and control goes to a step that sets the ink refill operation time in step S05 in FIG. 9 to the long time mode. Likewise, if the amount consumed is less than the specified usage value, the remaining fluid level is determined to be sufficient and control goes to a step that sets the ink refill operation time in step S06 in FIG. 9 to the short time mode. Operation thereafter is as described above.

Likewise, "the comparison means 113 then compares this remaining ink level with the specified value stored in the IC chip 102, and determines whether or not the remaining ink level is less than the specified value (evaluation step, step S14)" in the evaluation step, step S14, in FIG. 10 that changes the speed of carriage movement in the fluid refill operation changes to "the comparison means 113 compares this ink consumption with a specified usage value for fluid consumption corresponding to the remaining amount Y stored in IC chip 102, and determines the remaining ink level is low if the amount consumed, which is the amount used, is greater than or equal to the predetermined usage value," and control goes to a step that sets the speed of carriage movement in step S15 in FIG. 10 to the low speed mode. If the amount consumed is less than the specified usage, the remaining fluid level is determined to be sufficient and control goes to a step that sets the speed of carriage movement in step S16 in FIG. 10 to the high speed mode. Operation thereafter is as described above.

The foregoing embodiments store the predetermined value or predetermined usage amount used to determine if the ink level in the ink cartridge 17 is low or is sufficient in an IC chip 102 disposed to the ink cartridge 17, but these values may be stored in the storage means 114 of the inkjet printer 1 instead. This enables smoothly changing the mode of the ink refill operation based on a predetermined value or predetermined usage amount stored in a storage means 114 on the inkjet printer 1 side.

Further alternatively, data describing the relationship between the remaining ink level and negative pressure in the ink cartridge 17 may be stored as a map, and the predetermined value or predetermined usage amount may be set based on this map at the time of evaluation.

The foregoing embodiments calculate the remaining ink level in the ink cartridge 17 from the amount of ink discharged from the inkjet head 21, and determine whether or not to change the mode by comparing the remaining ink level with a predetermined value, but deciding whether to change the mode is not limited to the example described above.

When the remaining ink level in the ink cartridge 17 decreases, the negative pressure increases as described above and the load required to expand the ink chamber 50 and draw ink increases, and the carriage motor **26*b* current increases greatly. The calculation means 112 therefore determines the change in the current required to move the carriage 23 based on the carriage motor 26*b* current detected by the detection means 111 as a method of determining whether to change the mode. The comparison means 113 then determines if the change in current is greater than or equal to a predetermined amount of change stored in IC chip 102 or storage means 114. If the current change is greater than or equal to the predetermined amount of change, the remaining ink level in the ink cartridge 17** is determined to be low. As a result, the mode of the ink refill operation can be changed smoothly.

Furthermore, if a current threshold value is preset and the current required to move the carriage 23 is greater than or equal to the threshold value based on the carriage motor 26*b* current detected by the detection means 111, the remaining ink level in the ink cartridge 17 may be determined to be low. As a result, the mode of the ink refill operation can be changed smoothly. In this configuration the detection means 111 functions as a fluid level detection unit.

In addition to inkjet printers as described above, the fluid supply device according to the invention can be applied in fluid supply devices that supply fluid to fluid discharge heads for discharging a variety of fluids, including color agent discharge heads used in manufacturing color filters for liquid crystal displays, electrode material discharge heads used for forming electrodes in organic EL display and FED (field emission display) devices, and bio-organic material discharge heads used in biochip manufacture. The invention can also be used in a fluid supply device for a reagent discharge device used as a precision pipette.

The concept of a fluid as used herein also includes gels, high viscosity materials, and mixtures of a solid in a solvent, and the concept of an ink includes aqueous inks and oil-based inks.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A fluid supply device comprising:

a main tank in which a fluid is stored in a sealed storage unit of variable capacity;

a subtank having a fluid chamber of variable capacity to which fluid is supplied from the main tank;

a head that can discharge the fluid supplied from the subtank;

a carriage on which the head and the subtank are mounted;

an expansion mechanism that enables a fluid refill operation to expand the fluid chamber by a movement of the carriage and supply fluid from the main tank;

a fluid volume detection unit that detects fluid volume in the main tank; and a control unit that lengthens stop time of the carriage for the fluid refill operation when the fluid volume is low, as compared to when the fluid volume is sufficient.

2. The fluid supply device described in claim 1, wherein the control unit determines that the fluid volume detected by the fluid volume detection unit is sufficient when a remaining fluid volume is greater than or equal to a specified level and determines that the fluid volume is low when the remaining fluid volume is less than the specified level.

3. The fluid supply device described in claim 1, wherein the control unit slows the movement of the carriage for the fluid refill operation when the fluid volume is low, as compared to when the fluid volume is sufficient.

4. The fluid supply device described in claim 3, wherein the fluid volume detection unit obtains the fluid volume in the main tank by detecting volume of fluid discharged from the head.

5. The fluid supply device described in claim 4, wherein the control unit compares the remaining fluid volume in the main tank with a specified level, or compares used fluid volume with a specified usage value.

6. The fluid supply device described in claim 3, wherein the fluid volume detection unit obtains the fluid volume in the main tank from a rate of change in current required to move the carriage.

7. The fluid supply device described in claim 6, wherein the control unit determines the remaining fluid volume in the main tank is less than a specified level or used fluid volume is greater than or equal to a specified usage value when the rate of change is greater than or equal to a specified rate of change.

8. The fluid supply device described in claim 6, wherein the control unit determines the remaining fluid volume in the main tank is less than a specified level or used fluid volume is greater than or equal to a specified usage value when the current is greater than or equal to a threshold value.

9. A printing device that executes a printing process by discharging ink from a head onto a conveyed medium, comprising:

a printer case; and a fluid supply device within the printer case, the fluid supply device comprising a main tank in which a fluid is stored in a sealed storage unit of variable capacity;

a subtank having a fluid chamber of variable capacity to which fluid is supplied from the main tank;

a head that can discharge the fluid supplied from the subtank;

a carriage on which the head and the subtank are mounted;

an expansion mechanism that enables a fluid refill operation to expand the fluid chamber by a movement of the carriage and supply fluid from the main tank;

a fluid volume detection unit that detects fluid volume in the main tank; and a control unit that lengthens stop time of the carriage for the fluid refill operation when the fluid volume is low, as compared to when the fluid volume is sufficient.

10. The fluid supply device described in claim 9, wherein the control unit determines that the fluid volume detected by the fluid volume detection unit is sufficient when a remaining fluid volume is greater than or equal to a specified level and determines that the fluid volume is low when the remaining fluid volume is less than the specified level.

11. The fluid supply device described in claim 9, wherein the control unit slows the movement of the carriage for the fluid refill operation when the fluid volume is low, as compared to when the fluid volume is sufficient.

12. A control method for a fluid supply device, the control method comprising:

supplying fluid from a main tank in which a fluid is stored in a sealed storage unit of variable capacity, to a subtank having a fluid chamber of variable capacity to which fluid is supplied from the main tank, and to a head that can discharge fluid supplied from the subtank;

moving a carriage on which the head and the subtank are mounted;

expanding an expansion mechanism that enables a fluid refill operation;

wherein stop time of the carriage is lengthened for the fluid refill operation when the fluid volume is low, as compared to when the fluid volume is sufficient.

13. The control method for a fluid supply device described in claim 12, wherein the fluid volume is determined to be sufficient when a remaining fluid volume is greater than or equal to a specified level and determined to be low when the remaining fluid volume is less than the specified level.

14. The control method for a fluid supply device described in claim 13, wherein determining the level of fluid volume further comprises evaluating when the rate of change in the current required to move the carriage becomes equal to or greater than a specified rate of change.

15. The control method for a fluid supply device described in claim 13, wherein determining a level of fluid volume further comprises evaluating when the current required to move the carriage becomes greater than or equal to a threshold value.

16. The control method for a fluid supply device described in claim 2, wherein determining the level of fluid volume comprises detecting a volume of fluid discharged from the head.

17. The control method for a fluid supply device described in claim 12, wherein the expansion mechanism comprises a movable member which expands the fluid chamber and supplies fluid from the main tank, and moves in contact with a regulator part.

18. The control method for a fluid supply device described in claim 12, additionally comprising stopping the moveable carriage according to the stop time.

19. The control method for a fluid supply device described in claim 12, wherein movement of the carriage is slowed for the fluid refill operation when the fluid volume is low, as compared to when the fluid volume is sufficient.

* * * * *